US006883671B2

(12) United States Patent
Rushing

(10) Patent No.: US 6,883,671 B2
(45) Date of Patent: Apr. 26, 2005

(54) MERCHANDISE SHIPPING AND DISPLAY SYSTEM

(75) Inventor: Tom Rushing, Winston-Salem, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 19 days.

(21) Appl. No.: 10/391,165

(22) Filed: Mar. 18, 2003

(65) Prior Publication Data

US 2003/0173318 A1 Sep. 18, 2003

Related U.S. Application Data

(60) Provisional application No. 60/365,246, filed on Mar. 18, 2002.

(51) Int. Cl.[7] ..... A47F 5/08

(52) U.S. Cl. ..... 211/88.01; 211/106; 211/90.01; 206/736; 206/740; 206/741

(58) Field of Search ..... 211/88.01, 106, 211/90.01, 90.02, 73, 133.6; 206/736, 740, 741

(56) References Cited

U.S. PATENT DOCUMENTS

| | | | | |
|---|---|---|---|---|
| 2,518,779 | A | * 8/1950 | Hennessey | 206/564 |
| 2,812,852 | A | * 11/1957 | Samuels | 206/768 |
| 3,207,321 | A | * 9/1965 | Joyce | 211/126.5 |
| 3,528,558 | A | * 9/1970 | Williams | 211/59.2 |
| 3,581,906 | A | * 6/1971 | Joyce | 211/126.5 |
| 3,993,002 | A | 11/1976 | Stroh | |
| 4,116,330 | A | * 9/1978 | Ellis | 229/108 |
| 4,128,167 | A | * 12/1978 | Hogshead, III | 206/45.29 |
| 4,274,687 | A | 6/1981 | Bayles et al. | |
| 4,511,047 | A | * 4/1985 | Elinsky | 211/90.03 |
| 4,537,316 | A | 8/1985 | Simon et al. | |
| 4,697,776 | A | 10/1987 | Edson | |
| 4,705,175 | A | 11/1987 | Howard et al. | |
| 4,762,235 | A | 8/1988 | Howard et al. | |
| 4,765,492 | A | 8/1988 | Howard et al. | |
| 4,771,898 | A | 9/1988 | Howard et al. | |
| D297,998 | S | 10/1988 | Edson | |
| 4,813,535 | A | * 3/1989 | Radocha et al. | 206/738 |
| D305,839 | S | 2/1990 | Howard et al. | |
| 4,944,390 | A | * 7/1990 | Baucom et al. | 206/762 |
| 5,088,607 | A | 2/1992 | Risafi et al. | |
| 5,318,187 | A | * 6/1994 | Rosenthal | 211/88.01 |
| 5,372,273 | A | * 12/1994 | Eves | 220/507 |
| 5,626,246 | A | 5/1997 | Roddy et al. | |
| 5,664,690 | A | 9/1997 | Friesen | |
| 5,806,689 | A | 9/1998 | Mays et al. | |
| 5,816,419 | A | 10/1998 | Lamson | |
| 5,878,895 | A | 3/1999 | Springs | |
| 5,921,413 | A | 7/1999 | Knight et al. | |
| D417,801 | S | 12/1999 | Robert | |
| 6,027,017 | A | 2/2000 | Kuhn et al. | |
| 6,041,948 | A | 3/2000 | Filipak et al. | |
| 6,082,557 | A | 7/2000 | Leahy | |
| 6,142,316 | A | 11/2000 | Harbour et al. | |
| 6,170,678 | B1 | 1/2001 | de la Fuente | |
| 6,186,345 | B1 | 2/2001 | Robertson | |
| 6,267,258 | B1 | * 7/2001 | Wilkerson et al. | 211/151 |
| 6,276,538 | B1 | 8/2001 | Battaglia et al. | |
| 6,332,547 | B1 | 12/2001 | Shaw et al. | |

FOREIGN PATENT DOCUMENTS

| | | |
|---|---|---|
| NL | 8702826 | 6/1989 |

* cited by examiner

*Primary Examiner*—Robert W. Gibson, Jr.
(74) *Attorney, Agent, or Firm*—Kilpatrick Stockton LLP

(57) ABSTRACT

A system and method for shipping and displaying merchandise items includes a shipping display container having a front, back, and two side walls, a bottom, and dividers between the front and back walls for aligning merchandise items in rows. The container includes notches on both side walls adapted to engage a support frame and maintain the container in stable position. Such a system and method for provide for efficient utilization of space in both shipping and display of merchandise items and for stable positioning of shipping containers during shipping in a retail display.

24 Claims, 3 Drawing Sheets

MERCHANDISE SHIPPING AND DISPLAY SYSTEM

CROSS-REFERENCE TO RELATED APPLICATIONS

This application claims priority to pending U.S. Provisional Patent Application No. 60/365,246, filed Mar. 18, 2002, which is incorporated herein in its entirety.

COPYRIGHT NOTIFICATION

A portion of the disclosure of this patent document and its attachments contain material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

FIELD OF THE INVENTION

The present invention relates to a system and method for shipping and displaying merchandise items. Embodiments of the present invention provide for efficient utilization of space in both shipping and display of merchandise items and for stable positioning of shipping containers during shipping and in a retail display.

BACKGROUND OF THE INVENTION

In the retail sales industry, it is common to display goods for sale using a sales display, sales rack, or similar device for displaying the goods to customers. A conventional approach to displaying merchandise items in a retail store is to place a shipping container in which the merchandise items are shipped directly on a shelf. A disadvantage of using such containers for displaying retail products is that shipping containers are often designed primarily to provide protection to the contained products during shipping. As a result, such shipping containers do not provide for stable retail display of the container or contained items. The container can become misaligned on a shelf and even knocked off the shelf, causing the merchandise contents to be spilled out of the container and/or soiled or damaged. Misaligned containers are not aesthetically pleasing to customers, may be relocated to an incorrect position relative to product and pricing information on the shelf, and increase time and labor costs to reposition the shipping containers in the proper place on the shelf.

In the retail clothing industry, a conventional approach to displaying items, such as socks, for sale is to package a pair or multiple pairs of socks together using a hook or similar packaging means and hang the package on a peg or other display for hanging packages. One problem with this typical method of displaying items is that a certain amount of space is required between each row and between each column of items to allow for placing and removing the items without disrupting items on adjacent pegs. For example, in order for customers to reach between rows and columns to retrieve socks displayed in this fashion, a space of one to two inches generally is left between each row and column. As a result, a significant amount of space is used to display such items, which decreases the available retail floor space for other items.

In attempt to solve this problem of inefficient space utilization, various merchandise displays place like items together in a single container. Such containers can have dividers, or partitions, to organize the items in rows. Dividers within containers of items generally comprise less space between rows of items than the space required when items are mounted on rows and columns of pegs on a display board or wall. However, dividers that maintain proper alignment of merchandise items in a retail display have not been used in shipping containers for displaying items.

Thus, there is a need for a system and method for shipping and displaying merchandise items that provides for stable positioning of shipping containers in a retail display. There is also a need for a system and method for shipping and displaying merchandise items that provide for efficient utilization of space in both shipping and display of merchandise items.

SUMMARY OF THE INVENTION

The present invention provides a system and method for shipping and displaying merchandise items. Embodiments of such a system and method provide for efficient utilization of space in both shipping and display of merchandise items and for stable positioning of shipping containers during shipping and in a retail display.

In embodiments of the present invention, a shipping container display system provides for shipping and displaying a plurality of merchandise items in the same container. Such a shipping and display merchandise container comprises a bottom, a front wall, a back wall, two side walls, and a plurality of dividers extending from the front wall to the back wall. Two dividers and the bottom combine to form a track, or channel, in which a row of merchandise items are arranged. The front wall is engaged with the dividers to prevent the merchandise items within the row from falling off the front of the container when displayed.

The shipping container display system includes a support frame designed to be attached to a vertical display surface in a retail setting. The support frame comprises a front support member, a back support member, and two side support members. The front, back and two side support members of the support frame are attached to each other form a frame slightly less in dimensions than the perimeter of the bottom of the shipping display container. The support frame is thus adapted to receive the shipping and display container. At least one bottom support member is attached to and depends downward from the back support member. The bottom support member(s) form an angle and extend therefrom to a point of attachment to the front support member. The bottom support members are configured to support the bottom of the shipping display container when the container is placed over and within the support frame. A product information display panel depends downwardly from the front support member of the support frame. Graphic product information, such as brand name, size, and price can be displayed on the product information display panel. Such information can be displayed in a variety of ways. For example, product information can be affixed with labels or by providing a transparent plastic laminate cover attached to the face of the panel and sliding cards with product information underneath the cover.

Embodiments of the present invention include a means for securing a shipping and display container to the support frame. In embodiments, the means for securing a container to the frame comprises two notches, or grooves, preferably near the end of each side wall for engaging the support frame. Such notches in each side wall allow the container to be placed over the support frame such that the shipping container is stabilized in position on the frame and does not move from its desired position. Positioning the shipping container by aligning the two notches in both side walls over the side support members of the support frame and mounting the container over the frame provides a means for interlocking the shipping container into a stable position.

In alternative embodiments, both the side walls of the shipping container and the side support members of the support frame comprise notches in corresponding locations so that when the shipping container is positioned over the support frame, the notches on the shipping container align with the notches on the support frame. When the shipping container is place on the support frame, the notches on the shipping container and support frame interlock to stabilize the shipping container in a desired position. As a result, the shipping container, and the merchandise items shipped therein, remain in the correct position relative to product and pricing information on the shelf. Since the shipping and display container is stabilized in position, time and labor costs to reposition the shipping containers in the proper place on the shelf is decreased. The merchandise items shipped in the shipping container are thus displayed in the proper position for customer viewing and easy retrieval.

The support frame is mounted to a vertical display surface, such as a peg board or wall. In a preferred embodiment, the vertical display surface is provided with a snap-lock mechanism having prongs for snapping the back frame member into place between the prongs and securing the support frame to the display surface. Other embodiments include different mechanisms, for example a hook or a screw, for mounting the support frame to the vertical display surface.

The present invention provides dividers in a shipping container that conserve space during shipping and that provide efficient space utilization for displaying items on a retail floor. In embodiments, the dividers are parallel with each other and with the side walls of the shipping and display container to display merchandise items, such as individually packaged pairs of socks, in spatial alignment from the front to the back of the display container. Using dividers in such a manner allows more items to be packed for shipping and for display in the same container and allows more items to be shipped and displayed in a given space. Such alignment also maintains the individual packages of merchandise in an aesthetically pleasing arrangement for customer viewing. The dividers can be integrally made with the shipping and display container. Alternatively, the dividers are attached to the front and back walls of the container using attachment means such as glue, staples, and/or hook-and-loop type fasteners.

The side walls of such a shipping display container can be rectangular, with the front wall and back wall being the same height. In preferred embodiments, the front wall is shorter than the back wall such that the tops of the side walls are angled downward from the back wall toward the front wall. In this preferred embodiment, the product packages contained within the shipping display container are more exposed and the merchandise items can be easily viewed by customers.

In embodiments of the present invention, the support frame comprises bottom support members that are inclined such that the back of the bottom support members are lower than the front of the bottom support members. As a result, when a shipping and display container is placed over and within the support frame, the back of the shipping and display container is lower than the front of the container. Such an orientation of the container causes merchandise items within the container to be tilted slightly backwards. Individual packages of merchandise items that tilt in a rearward direction toward the back of the container are less likely to become dislodged from the container and are more likely to remain at an angle for customers to see graphic product information on the front of the packages. For merchandise items displayed at the lower portions of a retail display, for example, below waist level, packages that are titled slightly rearward provide a more direct line of sight for customers to view graphic product information on the front of the packages from a standing position. In addition, customers often pick up individual packages to inspect the packages and their contents more closely. When customers return the packages to the display container that is tilted in a slightly rearward direction, package repositioning will be aided by gravity such that the graphic product information on the front of the package will be viewable to the next customer.

In other embodiments, the support frame comprises bottom support members that are parallel with the floor in a horizontal position. When a shipping and display container is placed over and within a support frame having bottom support members that are parallel with the floor, the bottom of the display container is horizontal.

In a preferred embodiment, the two notches on each side wall of the shipping display container are positioned near the junctures, or corners, of the front support member and the side support members of the support frame. Notches near the front corners allows the front wall of the shipping display container to fit over the product information display panel of the support frame. Product information pertaining to the merchandise items shipped in the shipping display container can be provided on the front wall of the shipping display container. When the notches are aligned and the shipping display container is fit onto the support frame, the front wall of the shipping display container is fit over the product information display panel of the support frame. In this manner, the product information provided with the shipping display container is automatically displayed in the proper position for display over the product information display panel of the support frame.

In the present invention, embodiments of a shipping display container include a top for shipping, which can be removed upon arrival at a retail destination. Shipping display containers having a top provide protection to the merchandise items contained therein during shipping and provide for easy stacking of containers. In embodiments without a top, shipping display containers can still be stacked for shipping. Containers having rectangular sides can be oriented in the same direction for stacking. Containers having inclined sides can be oriented in opposite direction for stacking for efficient use of shipping space.

The combination shipping/display containers of the present invention can be re-used. For example, once the inventory of merchandise items in a particular container has been purchased, the container can be removed from the support frame by disengaging the notches on the side walls of the container from the support frame. The container can then be returned to the vendor for re-filling and subsequent return to the retail store for further display. Alternatively, the container can be left in place secured to the support frame and re-stocked with merchandise items in the store.

Shipping/display containers of the present invention can be made of any material suitable for shipping and use in display. Preferably, containers comprise lightweight, durable materials, such as corrugated paper board, that can be re-used. Other suitable materials include plastic and acrylic laminate.

In the present invention, a system for shipping and displaying merchandise items comprises a modular display system. A series of support frames can be mounted to a vertical display surface in a retail setting. A plurality of individual shipping display containers can be mounted to the series of support frames to create multiple rows and columns of shipping display containers to display merchandise items contained therein.

The present invention includes a method for shipping and displaying merchandise items. Such a method comprises packing rows of merchandise items separated by dividers in a shipping display container having notches on both side walls. Once the container arrives at its retail destination, the shipping display container is aligned over a support frame and the notches are fit over the support frame to secure the container into a stable position for display on a retail floor.

Features of a merchandise shipping and display system of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

A merchandise shipping and display system of the present invention provides numerous advantages over prior merchandise displays. For example, the present invention advantageously provides a system and method for shipping and displaying merchandise items in the same container that is adapted to provide stable positioning of the container in a retail display.

Another advantage is that the present invention provides for efficient utilization of space in both shipping and display of merchandise items, which allows greater shelf-space on a given footprint of valuable retail floor space.

Another advantage is that the present invention allows merchandise items to be displayed in a neat and orderly presentation. Individual items can be easily seen and removed by customers for purchase.

Still another advantage is that the present invention provides a system for shipping and displaying merchandise items that can be readily attached to an existing structure and thus be placed at strategic locations. As such, such a system can be easily and quickly mounted in place and removed as necessary.

Another advantage is that the present invention makes re-stocking of product easy and uncomplicated.

Another advantage is that the present invention can be constructed of a lightweight, durable material that is easily transportable. Embodiments of the present invention can be easily and inexpensively manufactured.

Yet another advantage is that the present invention provides a modular merchandise display system designed to display packaged goods in multiple sections, each section having a plurality of compartments to ship, store, display, and dispense products.

As will be realized by those of skill in the art, many different embodiments of a merchandise shipping and display system according to the present invention are possible. Additional uses, objects, advantages, and novel features of the invention are set forth in the detailed description that follows and will become more apparent to those skilled in the art upon examination of the following or by practice of the invention.

DETAILED DESCRIPTION

Figure 1:
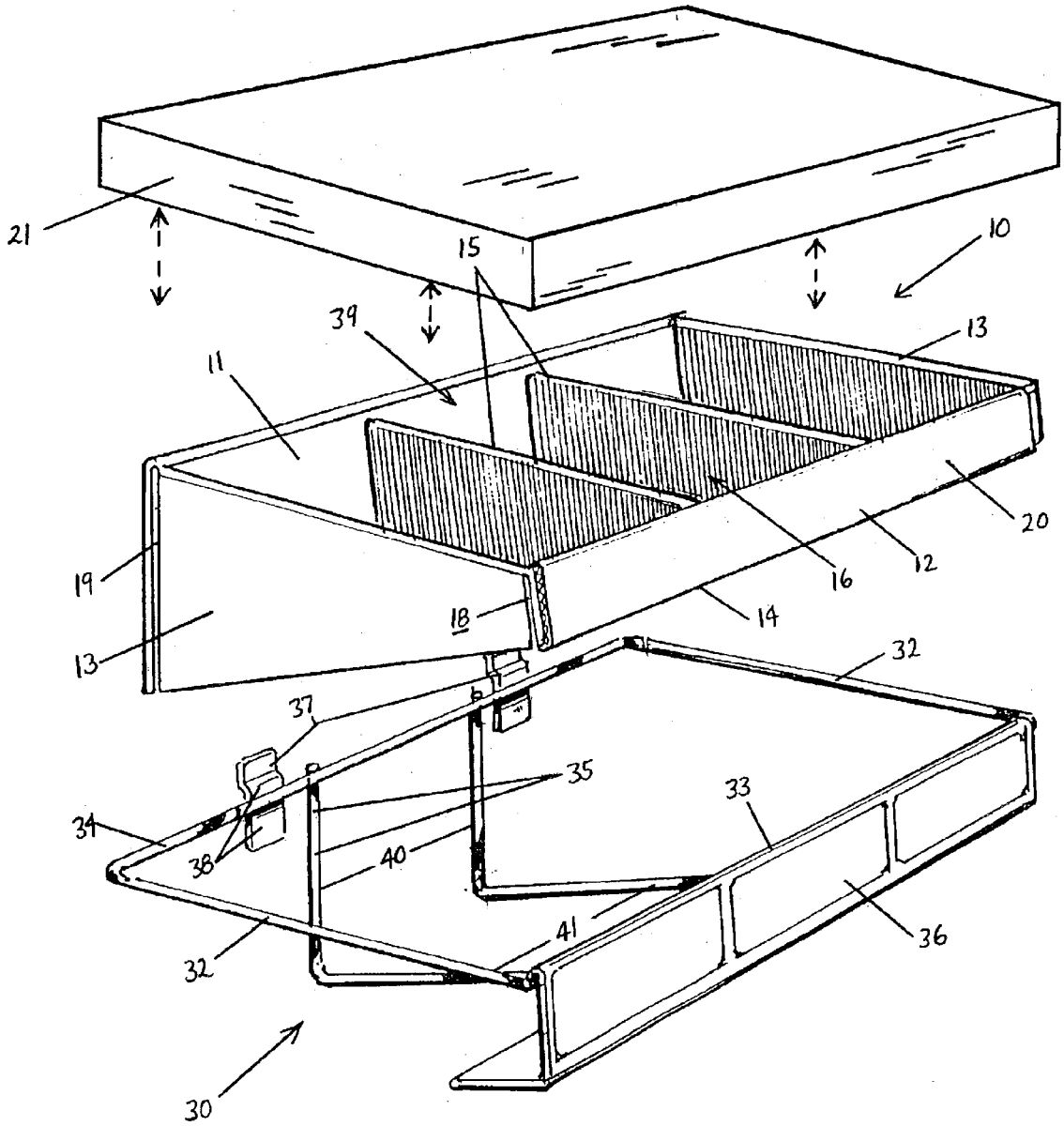
FIG. 1 is a perspective view of a shipping display container and a support frame in an embodiment of a merchandise shipping display container system of the present invention.
Figure 2:
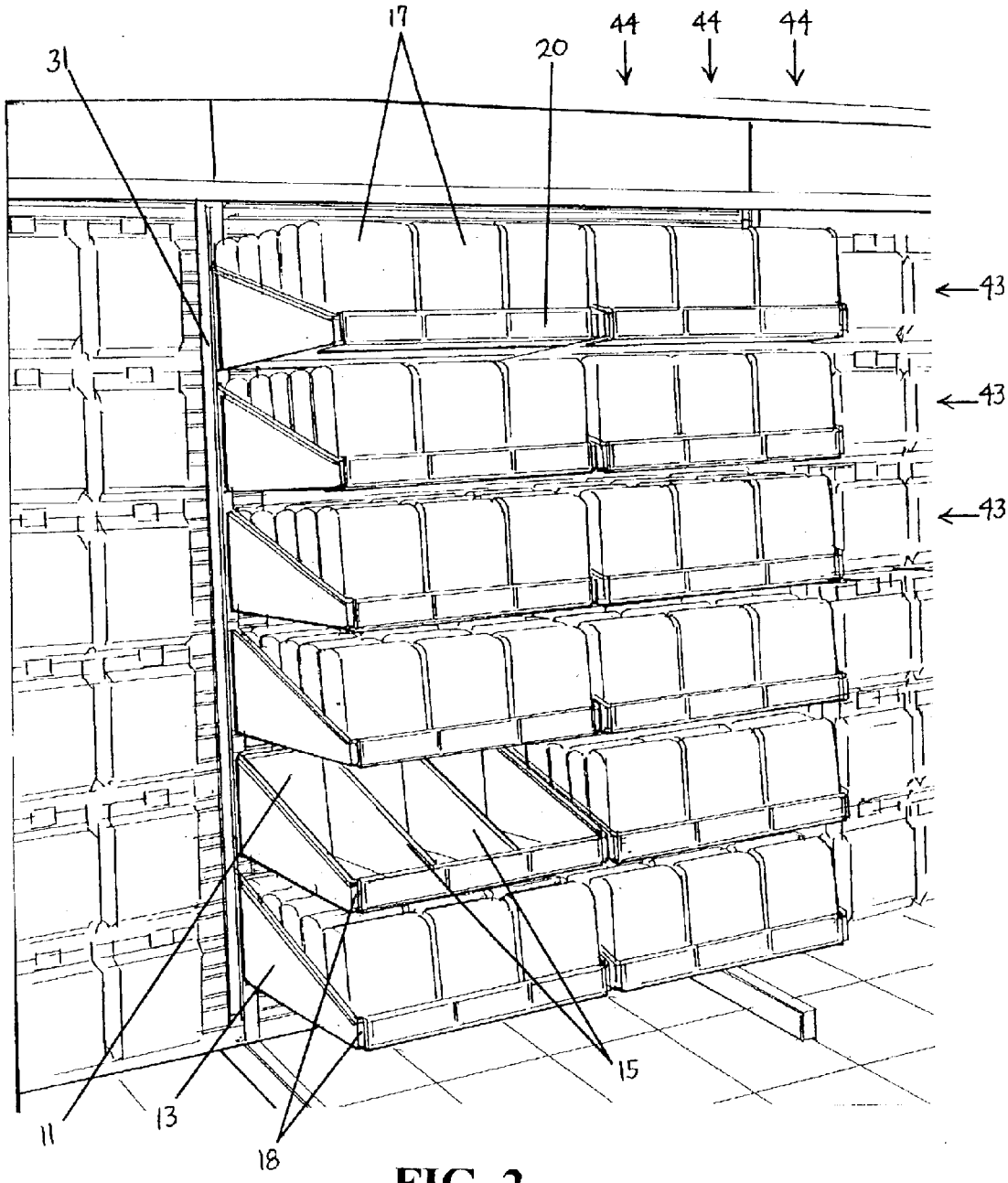
FIG. 2 is a view of a plurality of the merchandise shipping display containers of FIG. 1, as shown displayed on a retail setting in an embodiment of the present invention.
Figure 3:
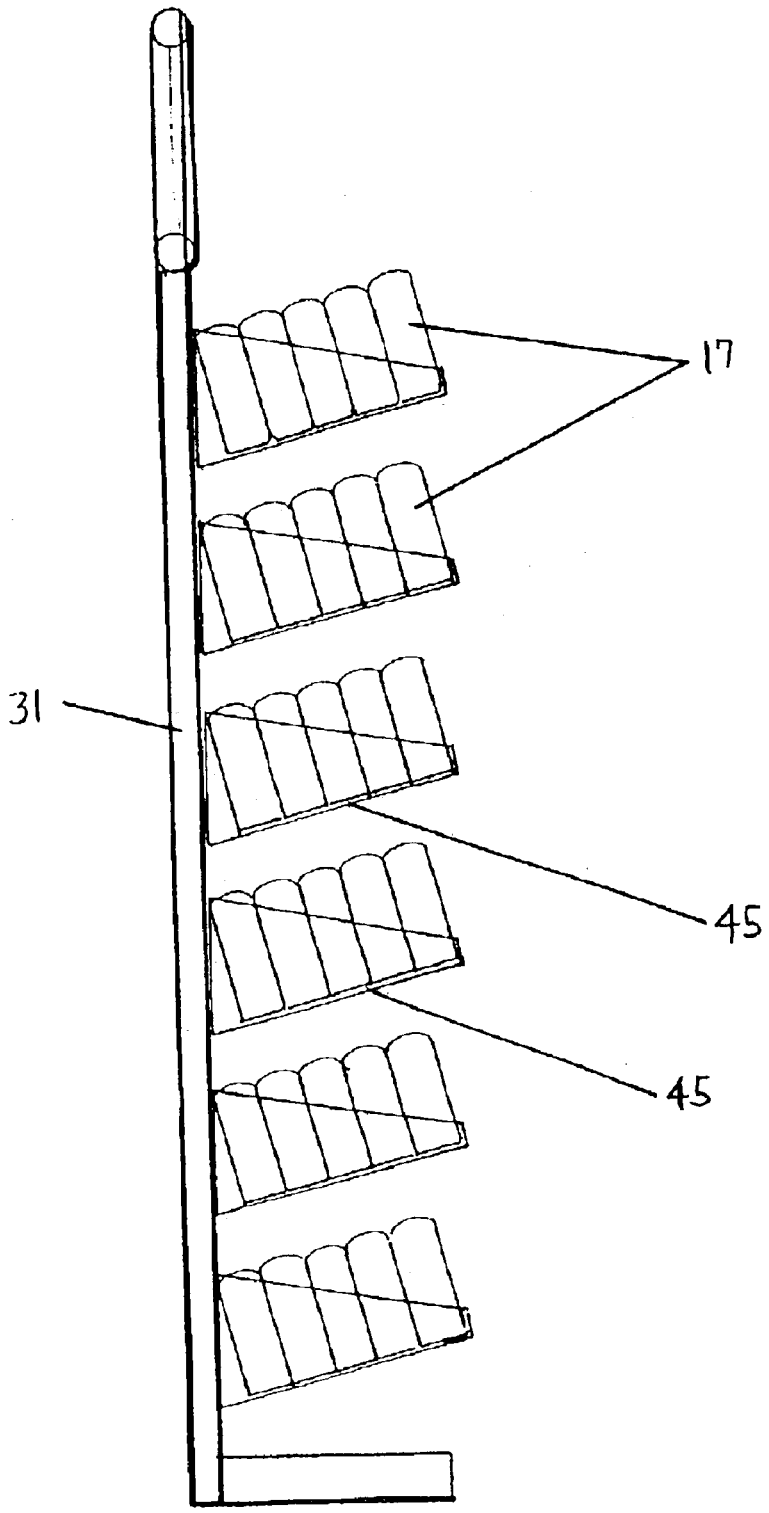
FIG. 3 is a side view of the merchandise shipping display container system shown in FIG. 2, showing an angled display container in an embodiment of the present invention.

In embodiments of the present invention, a system for shipping and displaying merchandise items provides for shipping and displaying a plurality of merchandise items in the same container. Such embodiments provide for efficient utilization of space in both shipping and display of merchandise items and for stable positioning of shipping containers during shipping and in a retail display. FIGS. 1–3 shows such embodiments.

Referring to FIG. 1, a shipping display container 10 of the present invention includes a back wall 11, a front wall 12, and two side walls 13. Each of the walls 11, 12, 13 are attached to a bottom 14. One or more dividers 15 is attached to the front wall 11 and to the back wall 12 and extending between the front wall 11 and the back wall 12. The dividers 15 and the two side walls 13 are attached to the front wall 11 and the back wall 12 in parallel relationship. The divider 15 and one of the two side walls 13 form a display channel 16 for displaying a plurality of merchandise items 17 in spatial alignment. The front wall 11 prevents the merchandise items 17 within the display channel 16 from falling out the front of the container. 10 when displayed. Using dividers 15 in such a manner allows more merchandise items 17 to be packed for shipping and for display in the same container and thus allows more items to be shipped and displayed in a given space. Such alignment also maintains the individual packages of the merchandise items 17 in an aesthetically pleasing arrangement for customer viewing.

The shipping display container 10 includes a notch 18 in each side wall 13 near the front wall 12 and a notch 19 in each side wall 13 near the back wall 11 for mounting the shipping display container 10 onto a support surface shaped to receive the notches 18, 19. The shipping display container 10 further includes a removable shipping top 21. The front wall 12 comprises a product information display panel 20. After the shipping display container 10 is shipped to a retail setting, the plurality of merchandise items 17 is aligned for display and the shipping display container 10 is stably displayed on the support surface.

In embodiments, the dividers 15 are constructed as an integral component of the shipping display container 10.

In embodiments of the present invention, the shipping display container 10 includes a plurality of the shipping display containers 10. Each of the shipping display containers 10 has a shape that is complementary to the shape of the other shipping display containers 10. As such, the shipping display containers 10 can be stacked in a stable manner for shipping.

In embodiments of the present invention, the shipping display container 10 is reusable for shipping and display of the merchandise items 17. The shipping display container 10 comprises a lightweight, durable material. The material can be a corrugated paper board material, a plastic material, or other lightweight, durable material suitable for shipping and display containers.

The present invention includes embodiments of a shipping display container system. Such a system includes a shipping display container 10 having a back wall 11, a front wall 12, and two side walls 13. Each of the walls 11, 12, 13 are attached to a bottom 14. At least one divider 15 is attached to the front wall 12 and to the back wall 11 and extends between the front wall 12 and to the back wall 11 in parallel relationship with the two side walls 13. The divider 15 and one of the two side walls 13 form a display channel 16 for displaying a plurality of merchandise items 17 in spatial alignment. The shipping display container 10 includes a removable shipping top 21.

A shipping display container system of the present invention further includes a support frame 30 attachable to a display surface 31 and adapted to receive the shipping display container 10. The support frame 30 includes two side support members 32 each attached to a front support member 33 and to a back support member 34 to form a frame. At least one bottom support member 35 is attached between and depends downward from the back support member 34 and the front support member 33 and is configured to support the bottom 14 of the shipping display container 10 when the container 10 is placed on the support frame 30. The support frame 30 includes a product information display panel 36 depending downwardly from the front support member 33 of the support frame 30. The support frame 30 comprises the approximate dimensions of the perimeter of the shipping display container bottom 14.

The shipping display container system includes a means for securing the shipping display container 10 to the support frame 30. In the embodiment shown in FIG. 1, the means for securing the shipping display container 10 to the support frame 30 includes in the shipping display container 10 a notch 18 in each side wall 13 near the front wall 12 and a notch 19 in each side wall 13 near the back wall 11. One side wall 13 is mountable over the outside of one side support member 32, and the other side wall 13 is mountable over the outside of the other side support member 32 for interlocking the shipping display container 10 into a stable position on the support frame 30.

In other embodiments, the means for securing the shipping display container 10 to the support frame 30 includes in the support frame 30 a notch (not shown) near the front support member 33 and a notch (not shown) near the back support member 34 in each side support member 32. The notches in the side support members 32 correspond to the notches 18, 19 in the shipping display container side walls 13. When the shipping display container 10 s mounted onto the support frame 30, the notches 18, 19 on the shipping display container 10 align with and engage the notches on the support frame 30.

When the shipping display container 10 is placed on the support frame 30, the notches 18, 19 on the shipping display container 10 and on the support frame 30 interlock to stabilize the shipping display container 10 in a desired position. As a result, the shipping display container 10, and the merchandise items 17 shipped therein, remain in the correct position relative to product and pricing information on a display shelf, for example. Since the shipping display container 10 is stabilized in position, time and labor costs to reposition the shipping display containers 10 in the proper place on the shelf is decreased. The merchandise items 17 shipped in the shipping display containers 10 are thus displayed in the proper position for customer viewing and easy retrieval.

In embodiments of the present invention, the shipping display container system further includes a means 37 for mounting the support frame 30 to the vertical display surface 31. In the embodiment shown in FIG. 1, the means 37 for mounting the support frame 30 to the vertical display surface 31 is a snap-lock mechanism having prongs 38 for snapping the back support member 34 into place between the prongs 38 and securing the support frame 30 to the display surface 31.

In embodiments of the shipping display container system, the front wall 12 of the shipping display container 10 comprises a product information display panel 20. As shown in FIG. 1, the front wall 12 of the shipping display container 10 is adapted to fit over the product information display panel 36 of the support frame 30. When the notches 18, 19 are aligned over the side support members 32 and the shipping display container 10 is mounted onto the support frame 30, the front wall 12 of the shipping display container 10 extends downward over the product information display panel 36 of the support frame 30. In this manner, the product information pertaining to the merchandise items 17 shipped in the shipping display container 10 and displayed on the front wall 12 of the container is automatically displayed in the proper position for display over the product information display panel 36 of the support frame 30.

In embodiments of the shipping display container system, the back wall 11 of the shipping display container 10 is taller than the front wall 12, and the side walls 13 are correspondingly angled between the back wall 11 and the front wall 12 to provide a deeper back portion 39 of the shipping display container 10 for positioning the merchandise items 17 at an angle 45 (as shown in FIG. 3) for increased visibility. In such embodiments, a back 40 of the bottom support member 35 extends farther downward and is lower than a front 41 of the bottom support member 35 for supporting the shipping display container 10 having a deeper back portion 39.

As a result, when the shipping display container 10 is placed over and within the support frame 30, the back portion 39 of the shipping display container 10 is lower than the front of the container 10. Such an orientation of the shipping display container 10 causes the merchandise items 17 within the container 17 to be tilted slightly backwards. Individual packages of the merchandise items 17 that tilt in a rearward direction toward the back portion 39 of the container 10 are less likely to become dislodged from the container 10 and are more likely to remain at the angle 45 for customers to see graphic product information on the front of the packages. For merchandise items 17 displayed at the lower portions of a retail display, for example, below waist level, packages that are titled slightly rearward provide a more direct line of sight for customers to view graphic product information on the front of the packages from a standing position. In addition, customers often pick up individual packages to inspect the packages and their contents more closely. When customers return the packages to the display container 10 that is tilted in a slightly rearward direction, package repositioning will be aided by gravity such that the graphic product information on the front of the package will be viewable to the next customer.

In other embodiments, the back wall 11, the front wall 12, and the side walls 13 each have the same height such that the shipping display container 10 has a rectangular shape. In such embodiments, the back 40 and the front 41 of the bottom support member 35 extend downward an equal distance so that the bottom support member 35 is horizontal for supporting the shipping display container 10 having a rectangular shape.

In embodiments, a shipping display container system of the present invention comprises a modular system. The modular system includes a plurality of the support frames 30 mounted to a vertical display surface 31 and a plurality of the shipping display containers 10 mounted to the plurality of the support frames 30 in a display configuration of multiple rows 43 and columns 44. Each of the plurality of the shipping display containers 10 is mounted in a non-spaced apart relationship with another of the plurality of the shipping display containers 10 in the rows 43 and columns 44.

Embodiments of the present invention include a method for shipping and displaying merchandise items. Such a method includes providing a shipping display container 10 having a back wall 11, a front wall 12, and two side walls 13. Each of the walls 11, 12, 13 is attached to a bottom 14. At least one divider 15 is attached to the front wall 12 and to the back wall 11 and extends between the front wall 12 and to the back wall 11 in parallel relationship with the two side walls 13. The divider 15 and one of the two side walls 13 form a display channel 16 for displaying a plurality of merchandise items 17 in spatial alignment. The shipping display container 10 includes a notch 18 in each side wall 13 near the front wall 12 and a notch 19 in each side wall 13 near the back wall 12 for mounting the shipping display container 10 onto a support surface shaped to receive the notches. The shipping display container 10 also includes a removable shipping top 21.

The method includes the steps of placing the plurality of merchandise items 17 in spatial alignment in the display channel 16 and covering the shipping display container 10 with the shipping top. The display shipping container 10 is then shipped to a retail setting. After the shipping display container 10 arrives at the retail setting, the shipping top is removed from the shipping display container 10. The shipping display container 10 is mounted onto a support surface shaped to receive the notches. In this manner, the spatially aligned merchandise items 17 are displayed in the shipping display container 10 at the retail setting. In an embodiment, the method can further include a plurality of the shipping display containers 10, each having a shape complementary to the shape of the other shipping display containers 10. As such, the shipping display containers 10 can be stacked in a stable stack for shipping.

In another embodiment of a method of the present invention, the shipping display container 10 is removed from the support surface, the shipping top is placed onto the shipping display container 10, and the shipping display container 10 is returned to a supplier for reuse.

In another embodiment of the present invention, a method for shipping and displaying merchandise items includes providing a plurality of the shipping display containers 10 and a plurality of support frames 30. Each support frame 30 is attachable to a display surface and adapted to receive the shipping display container. Each support frame 30 further includes two side support members 32, each attached to a front support member 33 and to a back support member 34 to form a frame. At least one bottom support member 35 is attached between and depends downward from the back support member 34 and the front support member 33, and is configured to support the bottom 14 of the shipping display container 10 when the container 10 is placed on the support frame 30. Each of the support frames 30 also includes a means 37 for securing the shipping display container 10 to the support frame 30.

The method further includes mounting the plurality of support frames 10 on a vertical display surface 31, and aligning the front notch 18 and the rear notch 19 in each side wall 13 of each shipping display container 10 over the side support members 32 of the support frame 30. The plurality of the shipping display containers 10 is then mounted onto the plurality of support frames 30, such that the plurality of shipping display containers 10 is stably positioned and the merchandise items 17 are displayed.

Although the present invention has been described with reference to particular embodiments, it should be recognized that these embodiments are merely illustrative of the principles of the present invention. Those of ordinary skill in the art will appreciate that a merchandise shipping and display system of the present invention may be constructed and implemented in other ways and embodiments. Accordingly, the description herein should not be read as limiting the present invention, as other embodiments also fall within the scope of the present invention.

What is claimed is:

1. A shipping display container, comprising:

a back wall, a front wall, and two side walls, each of the walls attached to a bottom;

at least one divider attached to the front wall and to the back wall and extending therebetween;

the divider and the two side walls attached in parallel relationship, the divider and one of the two side walls forming a display channel for displaying a plurality of merchandise items in spatial alignment;

a notch in each side wall near the front wall and a notch in each side wall near the back wall for mounting the shipping display container onto a support surface shaped to receive the notches; and a removable shipping top, wherein the plurality of merchandise items is aligned for display after the shipping display container is shipped to a retail setting, and wherein the shipping display container is stably displayed on the support surface.

2. The shipping display container of claim 1, wherein the front wall comprises a product information display panel.

3. The shipping display container of claim 1, wherein the at least one divider comprises integral construction with the shipping display container.

4. The shipping display container of claim 1, further comprising a plurality of the shipping display containers, each of the shipping display containers having a shape, wherein the shape of each shipping display container is complementary to the shape of the other shipping display containers for stable stacking during shipping.

5. The shipping display container of claim 1, wherein the shipping display container is reusable for shipping and display of the merchandise items.

6. The shipping display container of claim 1, further comprising a lightweight, durable material.

7. The shipping display container of claim 6, wherein the material is a corrugated paper board material.

8. The shipping display container of claim 6, wherein the material is a plastic material.

9. A shipping display container system, comprising:

a shipping display container comprising a back wall, a front wall, and two side walls, each of the walls attached to a bottom; at least one divider attached to the front wall and to the back wall and extending therebetween and in parallel relationship with the two side walls, the divider and one of the two side walls forming a display channel for displaying a plurality of merchandise items in spatial alignment; and a removable shipping top;

a support frame attachable to a display surface and adapted to receive the shipping display container, the support frame comprising two side support members each attached to a front support member and to a back support member to form a frame; at least one bottom support member attached between and depending downward from the back support member and the front support member and configured to support the bottom of the shipping display container when the container is placed on the support frame; and a means for securing the shipping display container to the support frame, comprising in the shipping display container a notch in each side wall near the front wall and a notch in each side wall near the back wall, wherein one side wall is mountable over an outside of one side support member and the other side wall is mountable over the outside of the other side support member for interlocking the shipping display container into a stable position on the support frame.

10. The shipping display container system of claim 9, wherein the support frame further comprises a product information display panel depending downwardly from the front support member of the support frame.

11. The shipping display container system of claim 9, wherein the support frame comprises the approximate dimensions of the perimeter of the shipping display container bottom.

12. The shipping display container system of claim 9 further comprising a means for mounting the support frame to a vertical display surface.

13. The shipping display container system of claim 12, wherein the a means for mounting the support frame to a vertical display surface comprises a snap-lock mechanism having prongs for snapping the back frame member into place between the prongs and securing the support frame to the display surface.

14. The shipping display container system of claim 9, wherein the front wall of the shipping display container is adapted to fit over the product information display panel of the support frame.

15. The shipping display container system of claim 14, wherein the front wall of the shipping display container comprises a product information display panel.

16. The shipping display container system of claim 9, wherein the back wall is taller than the front wall and the side walls are correspondingly angled between the back wall and the front wall to provide a deeper back portion of the shipping display container for positioning the merchandise items at an angle for increased visibility.

17. The shipping display container system of claim 16, wherein a back of the bottom support member extends farther downward and is lower than a front of the bottom support member for supporting the shipping display container having a deeper back portion.

18. The shipping display container system of claim 9, wherein the shipping display container system comprises a modular system.

19. The shipping display container system of claim 18, wherein the modular system further comprises a plurality of the support frames mounted to a vertical display surface and a plurality of the shipping display containers mounted to the plurality of the support frames in a display configuration of multiple rows and columns.

20. The shipping display container system of claim 19, wherein each of the plurality of the shipping display containers is mounted in a non-spaced apart relationship with another of the plurality of the shipping display containers in the rows and columns.

21. A method for shipping and displaying merchandise items, comprising:

providing a shipping display container comprising a back wall, a front wall, and two side walls, each of the walls attached to a bottom; at least one divider attached to the front wall and to the back wall and extending therebetween and in parallel relationship with the two side walls, the divider and one of the two side walls forming a display channel for displaying a plurality of merchandise items in spatial alignment; a notch in each side wall near the front wall and a notch in each side wall near the back wall for mounting the shipping display container onto a support surface shaped to receive the notches; and a removable shipping top;

placing the plurality of merchandise items in spatial alignment in the display channel;

covering the shipping display container with the shipping top;

shipping the shipping display container to a retail setting;

removing the shipping top from the shipping display container;

mounting the shipping display container onto a support surface shaped to receive the notches; and displaying the spatially aligned merchandise items in the shipping display container at the retail setting.

22. The method for shipping and displaying merchandise items of claim 21, further comprising a plurality of the shipping display containers, each of the shipping containers having a shape complementary to the shape of the other shipping display containers, the method further comprising stacking the shipping display containers in a stable stack for shipping.

23. The method for shipping and displaying merchandise items of claim 22, further comprising:

removing the shipping display container from the support surface;

placing the shipping top onto the shipping display container; and returning the shipping display container to a supplier for reuse.

24. The method for shipping and displaying merchandise items of claim 21, further comprising:

providing a plurality of the shipping display containers;

providing a plurality of support frames, each support frame attachable to a display surface and adapted to receive the shipping display container, each support frame further comprising two side support members each attached to a front support member and to a back support member to form a frame; at least one bottom support member attached between and depending downward from the back support member and the front support member and configured to support the bottom of the shipping display container when the container is placed on the support frame; and a means for securing the shipping display container to the support frame;

mounting the plurality of support frames on a vertical display surface;

aligning the front notch and the rear notch in each side wall of each shipping display container over the side support members of the support frame; and mounting the plurality of the shipping display containers onto the plurality of support frames, wherein the plurality of shipping display containers are stably positioned and the merchandise items are displayed.

* * * * *